US009206576B2

(12) United States Patent
Meier

(10) Patent No.: US 9,206,576 B2
(45) Date of Patent: Dec. 8, 2015

(54) COMPACTOR ROLLER FOR A SOIL COMPACTOR

(71) Applicant: HAMM AG, Tirschenreuth (DE)

(72) Inventor: Matthias Meier, Tirschenreuth (DE)

(73) Assignee: HAMM AG, Tirschenreuth (DE)

( * ) Notice: Subject to any disclaimer, the term of this patent is extended or adjusted under 35 U.S.C. 154(b) by 0 days.

(21) Appl. No.: 14/365,034

(22) PCT Filed: Nov. 23, 2012

(86) PCT No.: PCT/EP2012/073505

§ 371 (c)(1),
(2) Date: Jun. 12, 2014

(87) PCT Pub. No.: WO2013/107545

PCT Pub. Date: Jul. 25, 2013

(65) Prior Publication Data

US 2014/0369752 A1 Dec. 18, 2014

(30) Foreign Application Priority Data

Jan. 16, 2012 (DE) ..... 10 2012 200 557

(51) Int. Cl.
*E02D 3/026* (2006.01)
*E01C 23/12* (2006.01)

(52) U.S. Cl.
CPC ..... *E02D 3/0265* (2013.01); *E01C 23/12* (2013.01); *E02D 3/026* (2013.01)

(58) Field of Classification Search
CPC ..... E02D 3/026; E02D 3/0265; E01C 23/12
USPC ..... 404/121
See application file for complete search history.

(56) References Cited

U.S. PATENT DOCUMENTS

| | | | | | |
|---|---|---|---|---|---|
| 990,846 | A * | 5/1911 | Crandall | 299/40.1 |
| 2,893,298 | A | 7/1959 | Averette | |
| 3,099,191 | A | 7/1963 | Averette | |
| 3,274,908 | A * | 9/1966 | Grant et al. | 404/121 |
| 3,822,957 | A * | 7/1974 | Caron et al. | 404/121 |
| 4,668,122 | A * | 5/1987 | Riddle | 404/121 |
| 4,919,566 | A * | 4/1990 | Caron et al. | 404/121 |
| H946 | H * | 8/1991 | Lonn | 404/121 |
| 6,682,262 | B2 * | 1/2004 | Caron et al. | 404/124 |
| 7,108,452 | B2 * | 9/2006 | Caron et al. | 404/124 |
| 8,333,439 | B2 * | 12/2012 | Gibbins | 301/44.1 |

(Continued)

FOREIGN PATENT DOCUMENTS

| | | | |
|---|---|---|---|
| DE | 1297042 | A | 6/1969 |
| DE | 29918625 | U1 | 2/2000 |
| WO | 0186075 | A2 | 11/2001 |

OTHER PUBLICATIONS

Search Report with English translation in German application 10 2012 200 557.9 dated Oct. 31, 2012, 9 pages.

(Continued)

*Primary Examiner* — Abigail A Risic
(74) *Attorney, Agent, or Firm* — Rothwell, Figg, Ernst & Manbeck, P.C.

(57) ABSTRACT

The invention relates to a compactor roller for a soil compactor, comprising at least one exchangeable holder (22) on an outer circumference in order to attach a rolling tool (16).

30 Claims, 16 Drawing Sheets

(56) References Cited

U.S. PATENT DOCUMENTS

Figure 1:
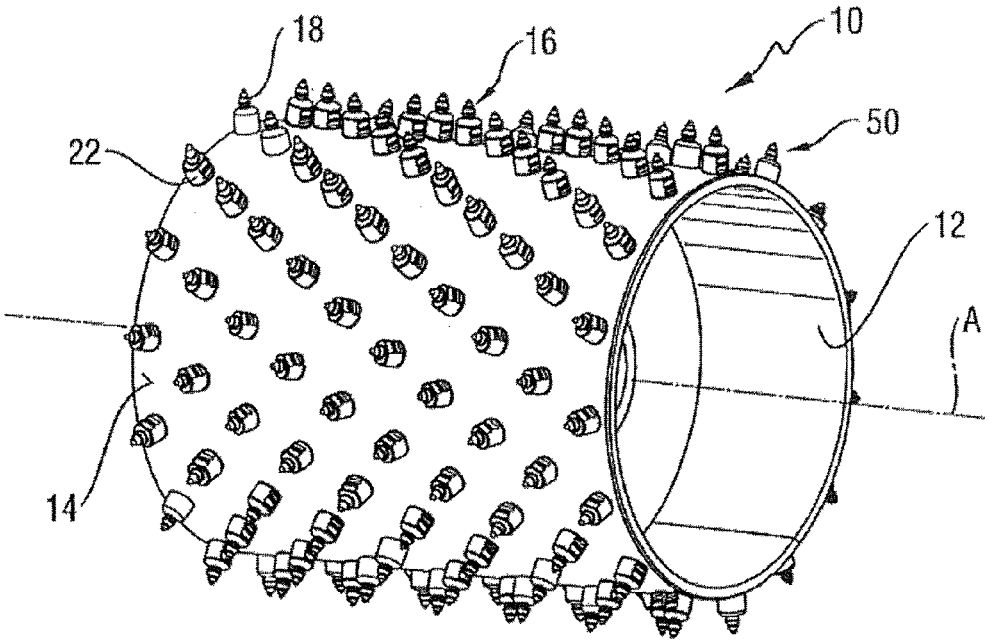

| | | | | |
|---|---|---|---|---|
| 8,496,402 | B2 * | 7/2013 | McPhail et al. | 404/124 |
| 2002/0114667 | A1 * | 8/2002 | Kaldenberg et al. | 404/124 |
| 2004/0033107 | A1 * | 2/2004 | Caron et al. | 404/124 |
| 2005/0225162 | A1 * | 10/2005 | Gibbins | 301/43 |
| 2006/0255653 | A1 * | 11/2006 | Gibbins | 301/43 |

OTHER PUBLICATIONS

International Search Report in PCT/EP2012/073505 dated Nov. 26, 2013, 5 pages.

Examination Report No. 1 issued for Australian patent application No. 2012366873 dated Jun. 22, 2015 (3 pages).

* cited by examiner 10a
18a
22a
12a 10a
20a
14a
50a
12a
A

COMPACTOR ROLLER FOR A SOIL COMPACTOR

CROSS REFERENCE TO RELATED APPLICATION

This application is a 35 U.S.C. 371 National Phase Entry Application from PCT/EP2012/073505, filed Nov. 23, 2012, which claims the benefit of DE 10 2012 200 557.9, filed Jan. 16, 2012, the disclosures of which are incorporated herein in their entirety by reference.

The present invention relates to a compactor roller for a soil compactor by means of which substrates can be compacted and/or broken.

A compact roller for a soil compactor is known from DE 299 18 625 U1 which at its outer circumference, in particular on the peripheral surface of a roller sleeve, carries a plurality of pad feet fastened by means of welding. Such compactor rollers are in particular used for compacting cohesive soils, like e.g. earth, clay or loamy soil. Owing to their insufficient crushing characteristics, such compactor rollers provided with pad feet are not suitable for other substrates to be processed such as rip-rap or the like.

It is the object of the present invention to provide a compactor roller for a soil compactor with which a high variability in use can be achieved.

According to the present invention, this object is attained by a compactor roller for a soil compactor comprising at least one change holder on the outer circumference for attaching a roller tool.

In the case of the compactor roller designed according to the present invention, the roller tools, such as pad feet, to be provided on the outer circumference thereof are not permanently fastened, by way of example, by means of welding, but by means of an change holder arrangement which allows for optionally attaching and also removing such roller tools from the compactor roller. On the one hand, this allows for a simple replacement of worn roller tools. On the other hand, it is possible to configure or modify one and the same compactor roller, in particular also without having to remove it from a soil compactor, for different types of use by replacing the roller tools and selecting the tool that is suitable or required for processing a certain substrate in each case.

In order to also achieve a good processing result, in particular a good compaction result taking into account the variability of the intended use, it is proposed that a plurality of rows annularly extending about an axis of rotation of the compactor roller each having a plurality of change holders is provided, where in a particularly preferred variant it is provided that the change holders are offset relative to one another in the direction of the rows that are immediately adjacent in the direction of the axis of rotation.

In order to attain the support interaction of a roller tool with the compactor roller in a simple manner, it is furthermore proposed that at least one roller tool to be fastened on an change holder comprises a counter-holder that can be brought into retaining engagement with an change holder and locked relative to the change holder.

In this way, a very stable support interaction can be accomplished in that the change holder or counter-holder comprises a holder opening and that the counter-holder or the change holder has a holder shaft that can be inserted into the holder opening.

With the counter-holder in retaining engagement with an change holder, the fixation of a roller tool can easily be accomplished in that the counter-holder can be locked to the change holder by means of a locking member. It should at this point be noted that an change holder, a holder shaft and a locking member respectively provided on the compactor roller provide an change holder arrangement in which the counter-holder or, as the case may be, also the locking member as well, to be used in each case is also replaced when the roller tool is replaced.

In an embodiment that can be realized in an easy and nevertheless stable manner it can be provided that the locking member comprises at least one locking pin, wherein locking pin receiving recesses, which are at least in part aligned with one another, are provided on the change holder and on the counter-holder when the holder shaft is inserted in the holder opening, whereas the locking stability can still be improved in that the locking member is configured as U shaped and provides two locking pins.

Chisels as well as, by way of example, so-called round shank chisels, as well as pad feet can respectively be used as roller tools in the compactor roller according to the present invention. In particular, when a pad foot is used as a roller tool it is an advantage to make sure that said pad foot is secured against rotation, and thus can be kept in a definite position on the outer circumference of the compactor roller. For this purpose, it can, by way of example, be provided that a pad foot used as a roller tool comprises an essentially curved contact area adapted to the curved outer circumference of the compactor roller.

Roller tools of the same type can be exclusively provided on the compactor roller. Alternatively, roller tools of at least two different types can be provided. In this case, in order to achieve an optimum processing result, it is advantageous if roller tools of one type and roller tools of another type preferentially alternate with each other in a periodic pattern in at least one row.

For stability reasons, an especially advantageous embodiment can provide that at least one change holder has a connection area that is preferentially adapted to the curved outer circumference of the compactor roller for connecting an outer peripheral surface of the compactor roller, as well as a support area spaced apart from the outer peripheral surface of the compactor roller configured for supporting a roller tool, wherein the at least one change holder is preferentially configured tapering from the connection area toward the support area.

If, in this case, the at least one change holder has two peripheral sides essentially oriented in the circumferential direction of the compactor roller as well as two axial sides essentially oriented in the direction of the axis of rotation of the compactor roller, the peripheral sides being preferentially inclined toward one another at a greater angle than the axial sides, the fact that the change holder performs a movement in the circumferential direction of the compactor roller while processing the soil can be accounted for by the so created in general rectangular contour of the at least one change holder, so that a uniform processing result can also be achieved independently of the direction of movement.

In order to also contribute to the soil processing with at least one change holder, it is furthermore proposed that between the connection area and the support area the at least one change holder has a soil processing area coming into contact with the soil to be processed when the roller tool is attached thereto. The interaction of the soil processing area with the soil to be processed can, in this case, be reinforced in that at least one soil processing projection is provided on at least one peripheral side in the soil processing area. If it is provided that the at least one soil processing projection has a projection height increasing away from the connection area to a maximum projection height, and/or has a maximum projection height decreasing toward the support area, the at least one soil processing area attains an in general tooth-like configuration which reinforces its effect on the soil to be processed, by way of example, stone to be crushed.

For a stable support of a roller tool attached to the at least one change holder, it can be provided that in the support area the holder opening is surrounded by a first support surface on the change holder that is essentially orthogonal relative to the radial direction of the axis of rotation of the compactor roller. In this case, a first counter-support area that can be supported on the first support surface is advantageously provided on at least one roller tool.

In order to achieve a mounting on the change holder that is stable against rotation it is proposed that a positive form-locking engagement formation is provided in the support area to create a positive form-locking engagement with a counter-positive form-locking formation on a roller tool.

By way of example, for a support interaction with a roller tool it can be provided that a plurality of second support surfaces arranged at an angle to one another is provided in the support area around the holder opening on the change holder, each second support surface being provided in the adjacent area of a peripheral side or an axial side. By means of the angular arrangement of the second support surfaces relative to one another and preferentially also to a radial direction relative to an axis of rotation of the compactor roller, or also to the peripheral or axial sides, an in general non-rotationally symmetric and peripheral positive form-locking ensuring configuration is attained by these second support surfaces as a whole that prevents the rotation of the roller tool when it is supported by these second support surfaces.

This positive form-locking interaction between the at least one change holder and a roller tool to be attached thereto can further be reinforced in that between two second support surfaces at least a third support surface arranged at an angle relative to the second support surfaces is provided in the support area on at least one axial side, and/or that between two second support surfaces at least a fourth support surface arranged at an angle relative to these two support surfaces is provided in the support area on at least one peripheral side. It is in this case in particular possible that the second support surfaces, and/or the third support surfaces, and/or the fourth support surfaces are arranged at an angle relative to the first support surface. For example, the second support surfaces can also, for example, annularly surround the first support surface together with the third and/or fourth support surfaces. This annular configuration of the second support surfaces, or, as the case may be, of the third support surfaces and, as the case may be, the fourth support surfaces allows for an attachment to the change holder that uniformly distributes the force acting on a roller tool in the change holder, nevertheless reliably preventing the rotation of the roller tool owing to the facet-like arrangement of the support surfaces.

For an interaction of a roller tool with these different support surfaces it can be provided that at least one roller tool at least has a second counter-support area as a support on a second support surface, and/or at least a third counter-support area as a support on a third support surface, and/or at least a fourth counter-support area as a support on at least a fourth support surface. Depending on the embodiment of a roller tool, it can also, by way of example, be provided that said roller tool only interacts with the change holder in the area of the second support surfaces to create an anti-rotation positive form-locking with the change holder as well. In another embodiment, the second and/or third support surfaces can alternatively or additionally also be included in the creation of this support interaction or anti-rotation positive form-locking.

In order to prevent, as far as possible, the formation of interfering surfaces parallel to the soil or substrate to be processed which affect the processing efficiency during soil processing, it is proposed that a transition area of at least one peripheral side, and/or of at least one axial side, and/or of at least the first support surface, and/or of at least a second support surface, and/or of at least a third support surface, and/or of at least a fourth support surface is chamfered or rounded relative to a respectively adjacent other side and/or surface.

For a stable connection of a roller tool to an change holder it can be provided that a locking-member receiving opening preferentially configured like an annular groove is provided on the inner surface of the holder opening, and/or that a second locking-member receiving opening is preferentially configured like an annular groove on the outer circumference of the holder shaft. In this case, the locking force can be transmitted between the change holder and a roller tool to be attached thereto in that, by way of example, a preferentially annular, locking member for locking a roller tool to an change holder, which can be engaged in the respectively other locking-member receiving opening, is received in the first locking-member receiving opening or in the second locking-member receiving opening.

In particular, if due to their essentially rotationally symmetric embodiment the formations used for locking can in fact prevent a detachment, but in principle cannot provide an anti-rotation effect, but a roller tool nevertheless has to be kept in a defined anti-rotation position on the change holder, it can be provided that a receiving opening is provided on a holder shaft provided on the roller tool for an anti-rotation member to be positioned engaging in an anti-rotation recess on the change holder.

Furthermore, the design can be such that at least one change holder preferentially encloses the inner space of an change holder with an outer peripheral surface of the compactor roller, the inner space of the change holder being open on at least one axial side essentially oriented in the direction of the axis of rotation of the compactor roller. In this case, the change holder is, for example, not configured as a massive material block fully adjoining the outer peripheral surface of the compactor roller, but rather it defines an inner space that is accessible on one axial side. In this way, not only is material saved in the construction of the change holder, but it is also possible to act on a roller tool attached to the change holder by means of a removal tool and detach it from the change holder.

In order to facilitate this interaction of a removal tool with a roller tool it is proposed that a holder shaft provided on the roller tool protrudes into the inner space of the change holder through a holder opening provided on the change holder when an change holder is attached thereto. The end of the holder shaft protruding over the holder opening into the inner space of the change holder is thus free for engaging a removal tool, so that by pushing the holder shaft out of the holder opening a locking member engaged in the respective locking-member receiving openings is detached from one of these openings and the roller tool can be slid off the change holder.

In another advantageous embodiment variant it is proposed that the holder opening provided on the change holder has a longitudinal opening axis essentially radially oriented relative to an axis of rotation of the compactor roller and that, when the roller tool is attached to the change holder, a longitudinal axis of the holder shaft provided on the roller tool is essentially radially oriented. This orientation of a holder opening, or of a holder shaft provided on a roller tool on the one hand simplifies the previously described removal process as well as the mounting process. On the other hand, it is ensured that in this way same force interaction characteristics between the holder shaft and the holder opening receiving it are achieved independently of the direction of movement, and thus a uniform stable mounting of a roller tool on the change holder can be ensured likewise independently of the direction of movement.

The present invention furthermore relates to a soil compactor having at least one compactor roller designed according to the present invention.

Figure 2:
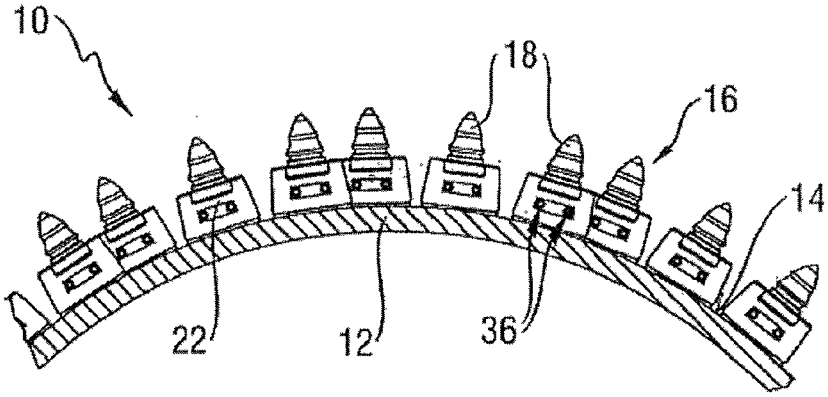
Figure 3:
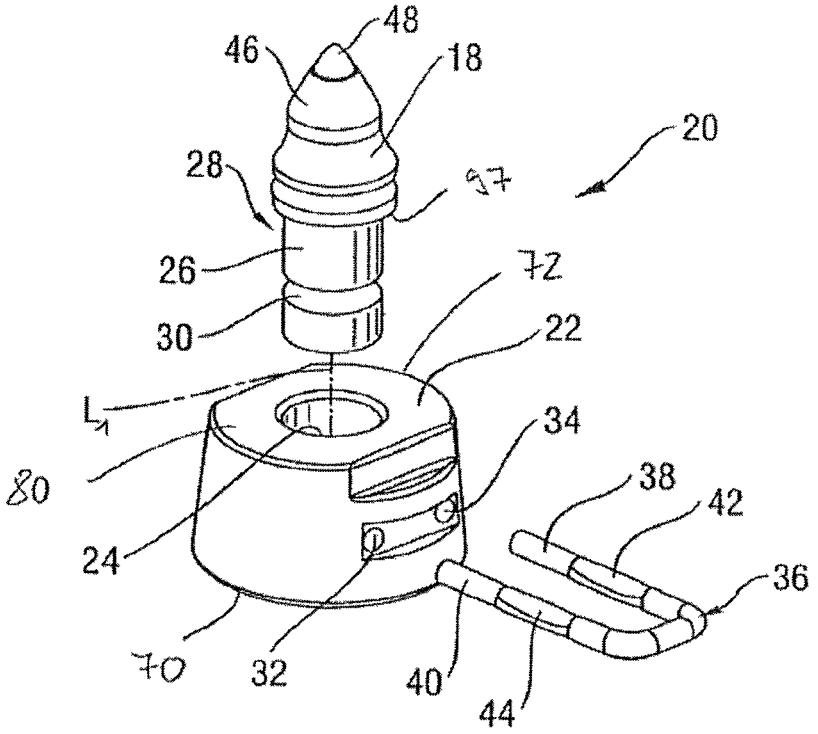
Figure 4:
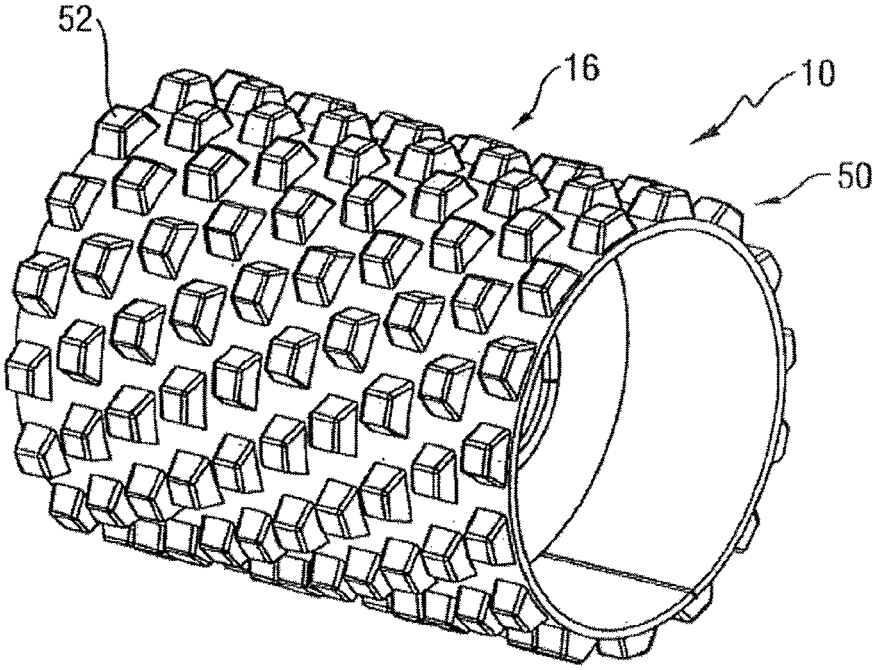
Figure 5:
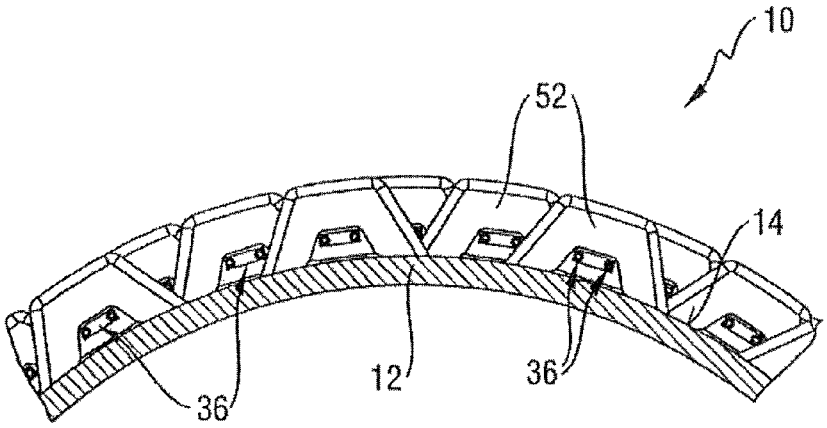
Figure 6:
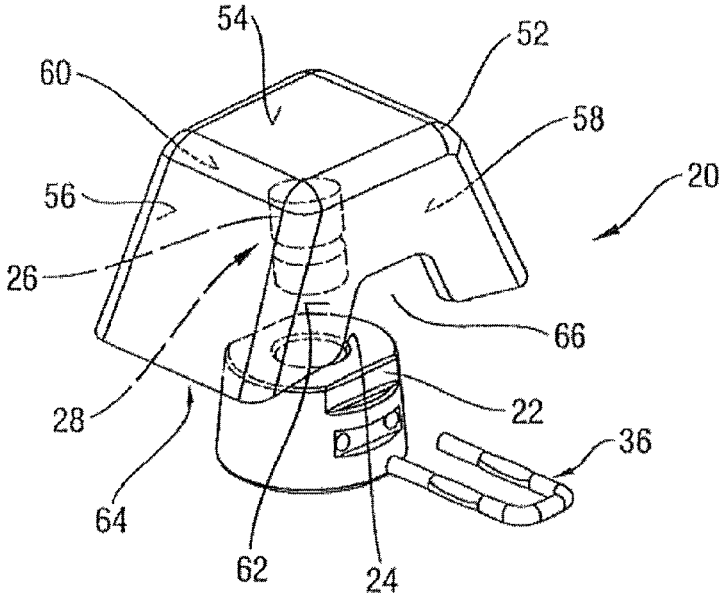
Figure 7:
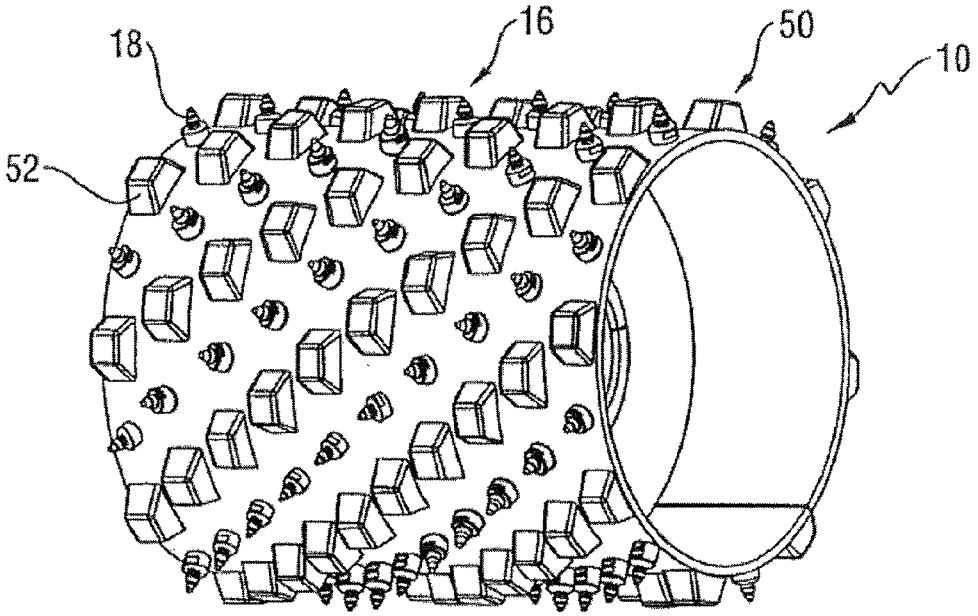
Figure 8:
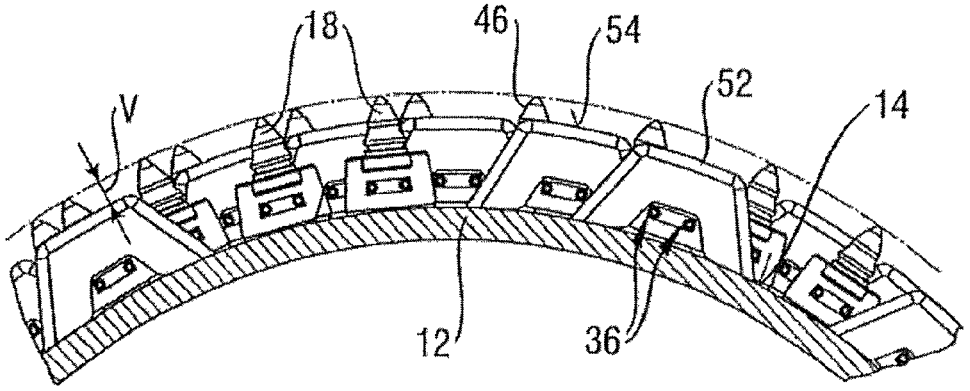
Figure 9:
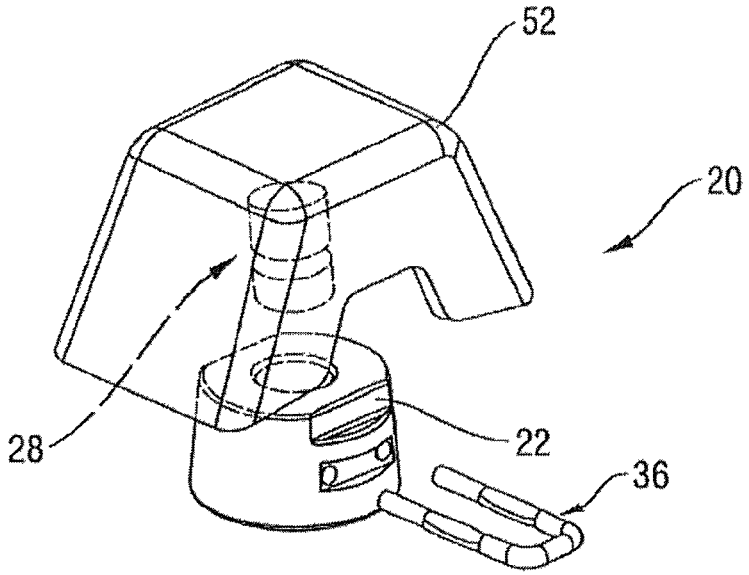
Figure 10:
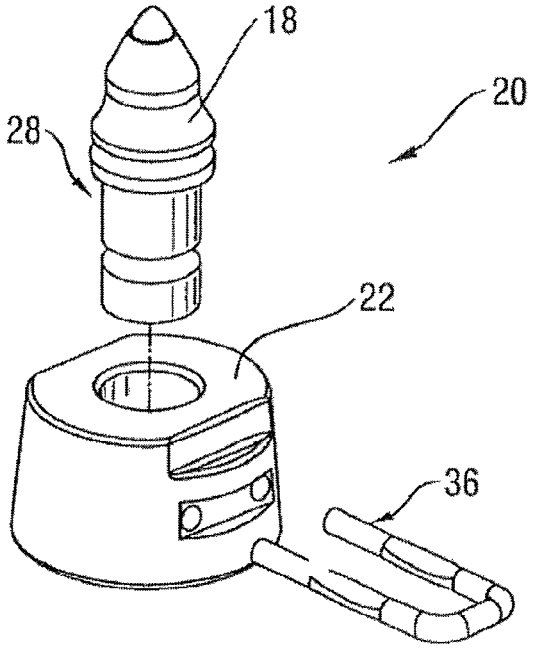
Figures 11, 12:
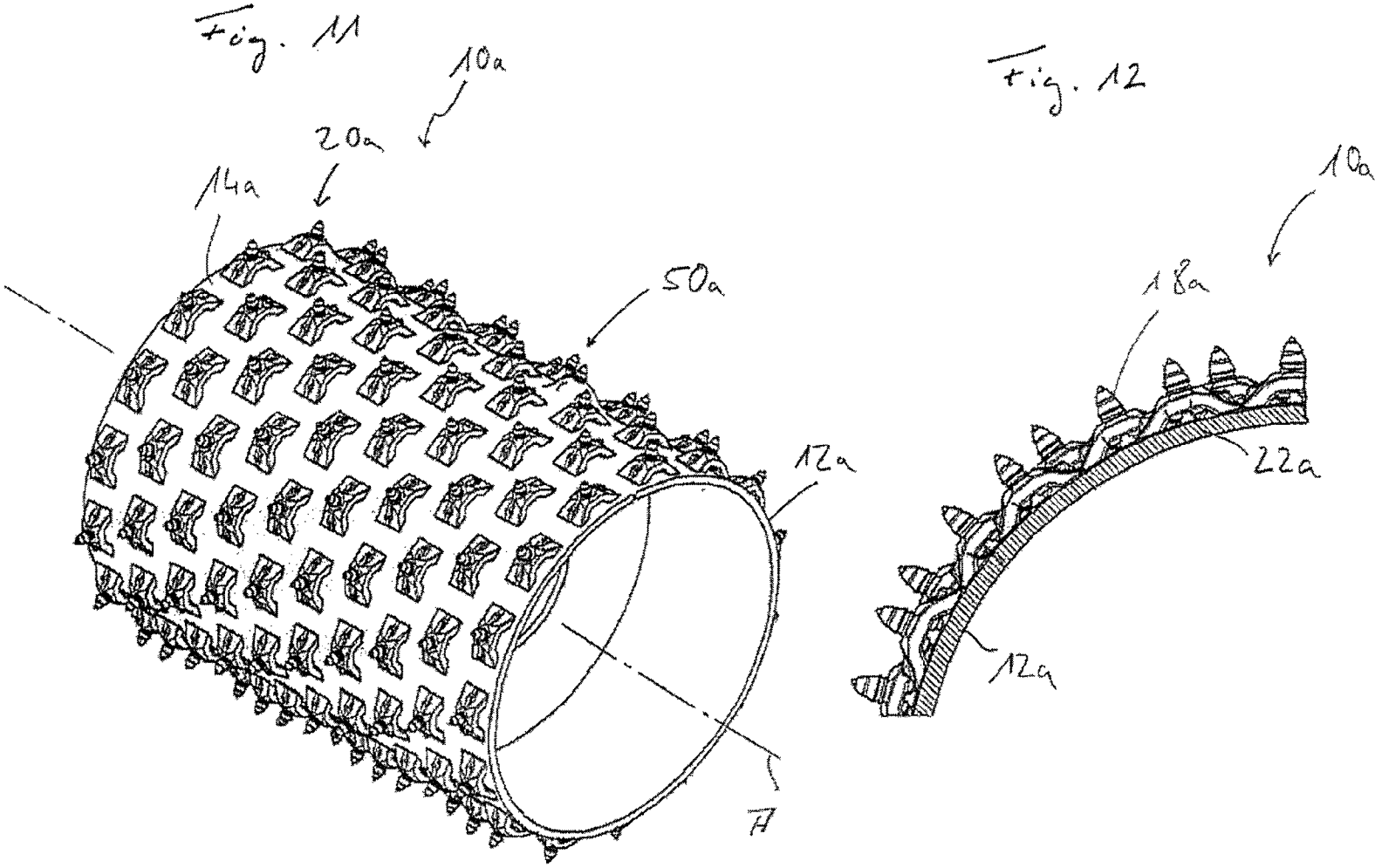
Figure 13:
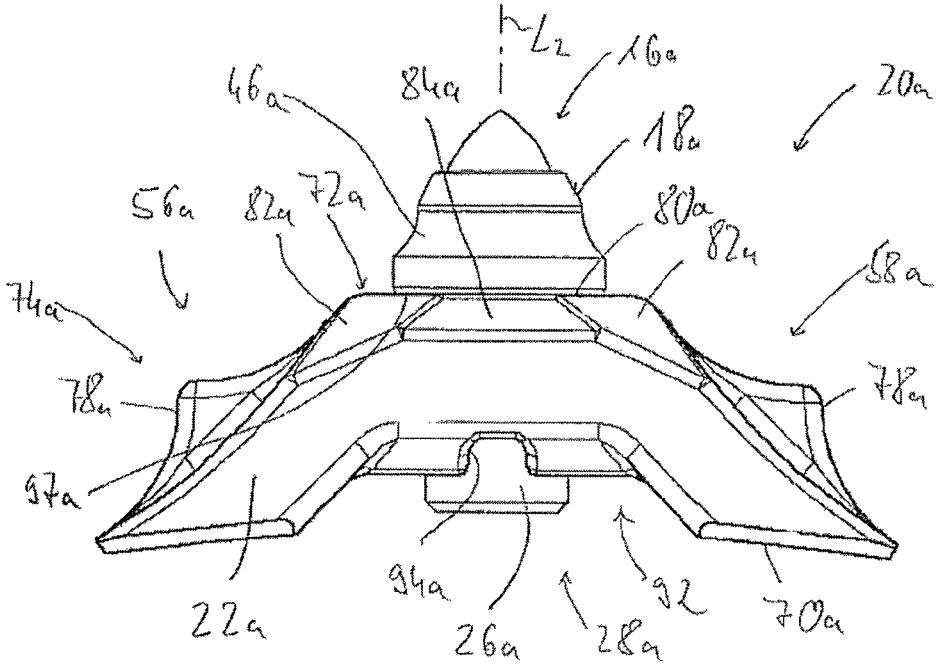
Figure 14:
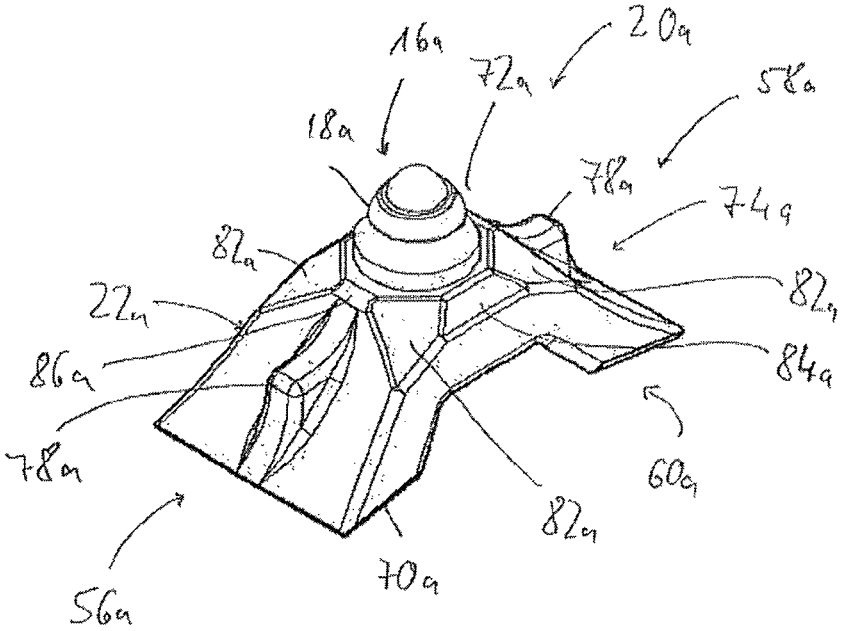
Figure 15:
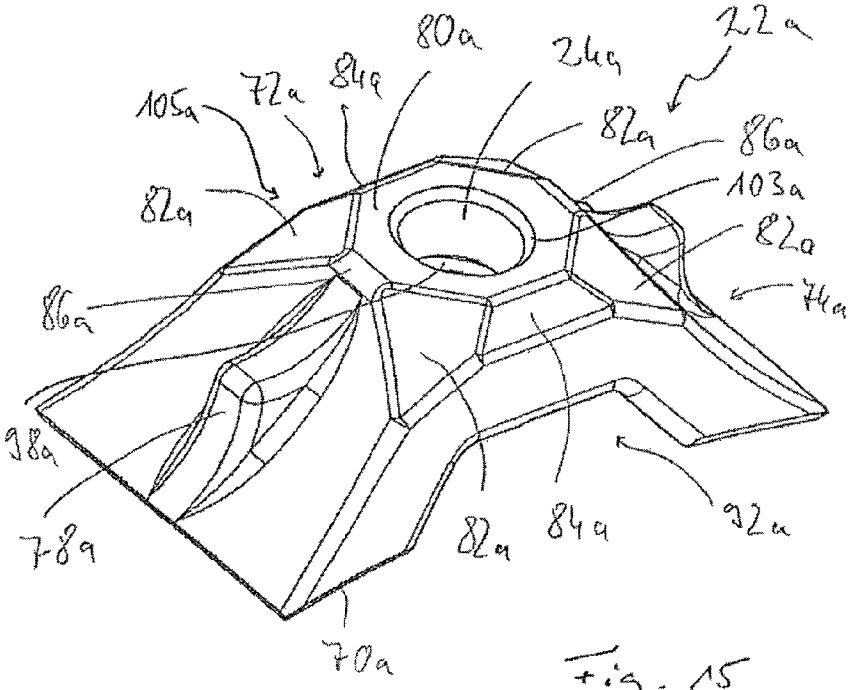
Figure 16:
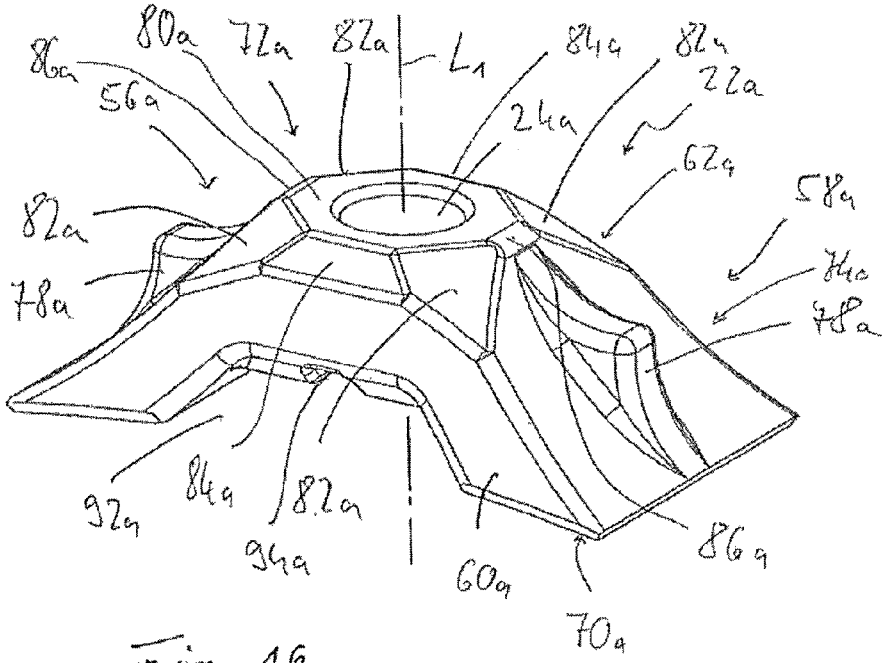
Figure 17:
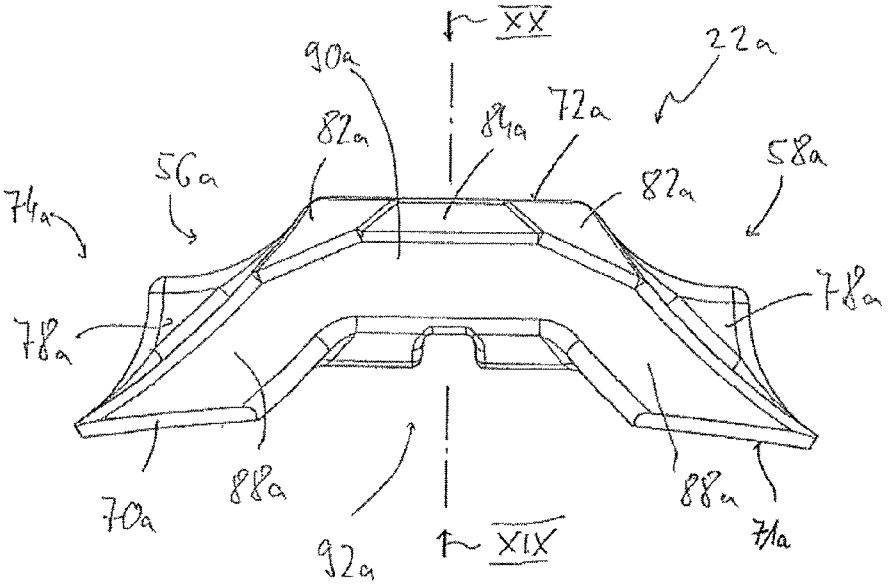
Figure 18:
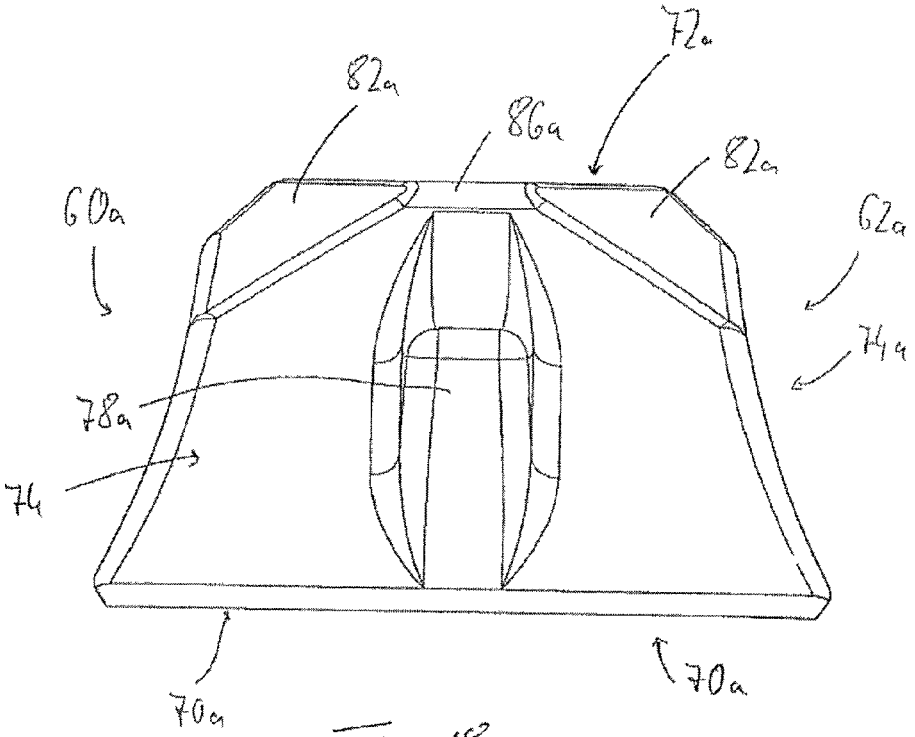
Figure 19:
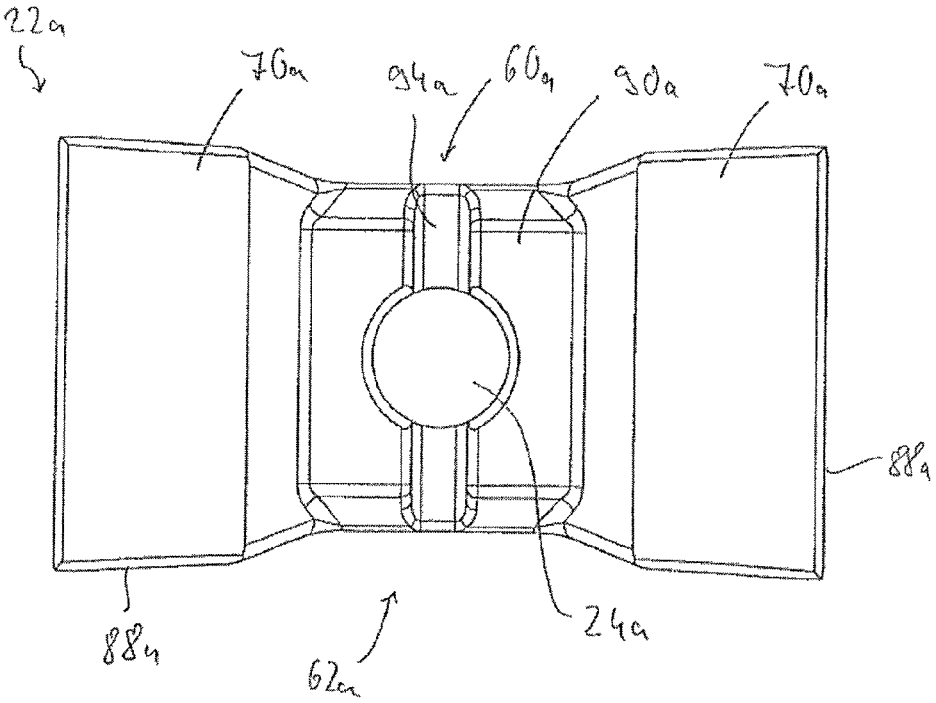
Figure 20:
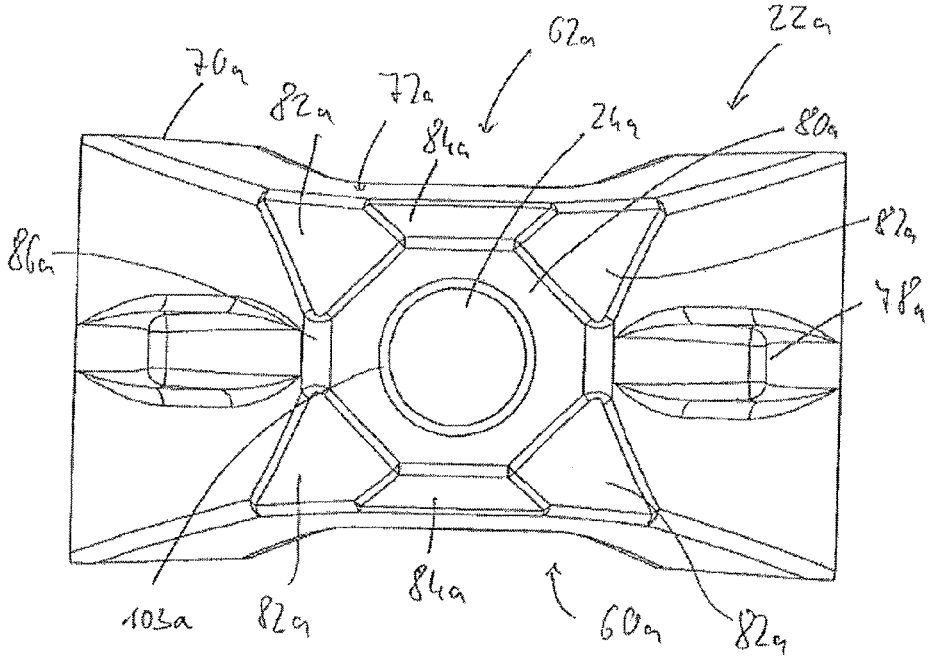
Figure 21:
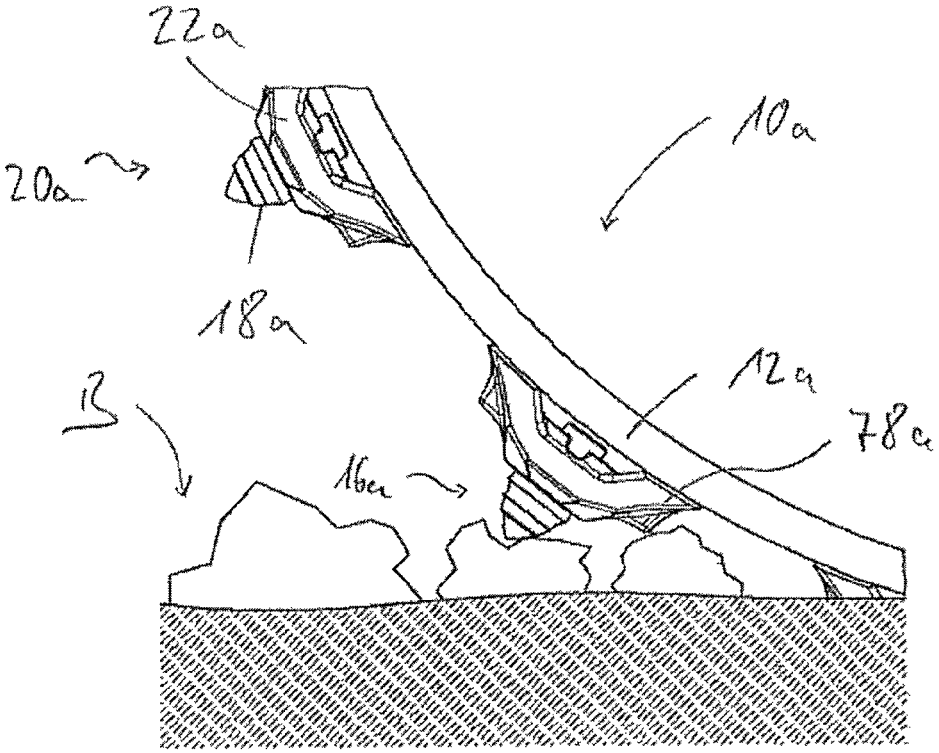
Figure 23:
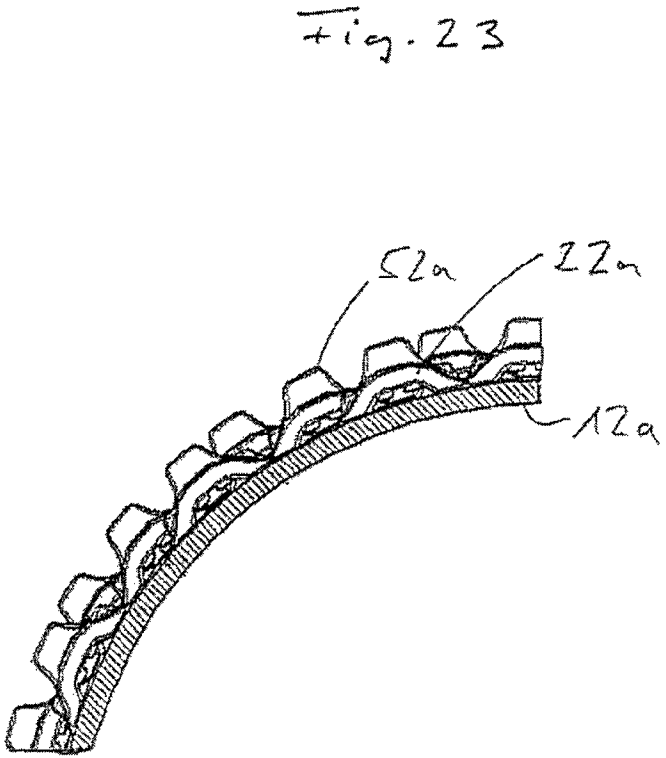
Figure 22:
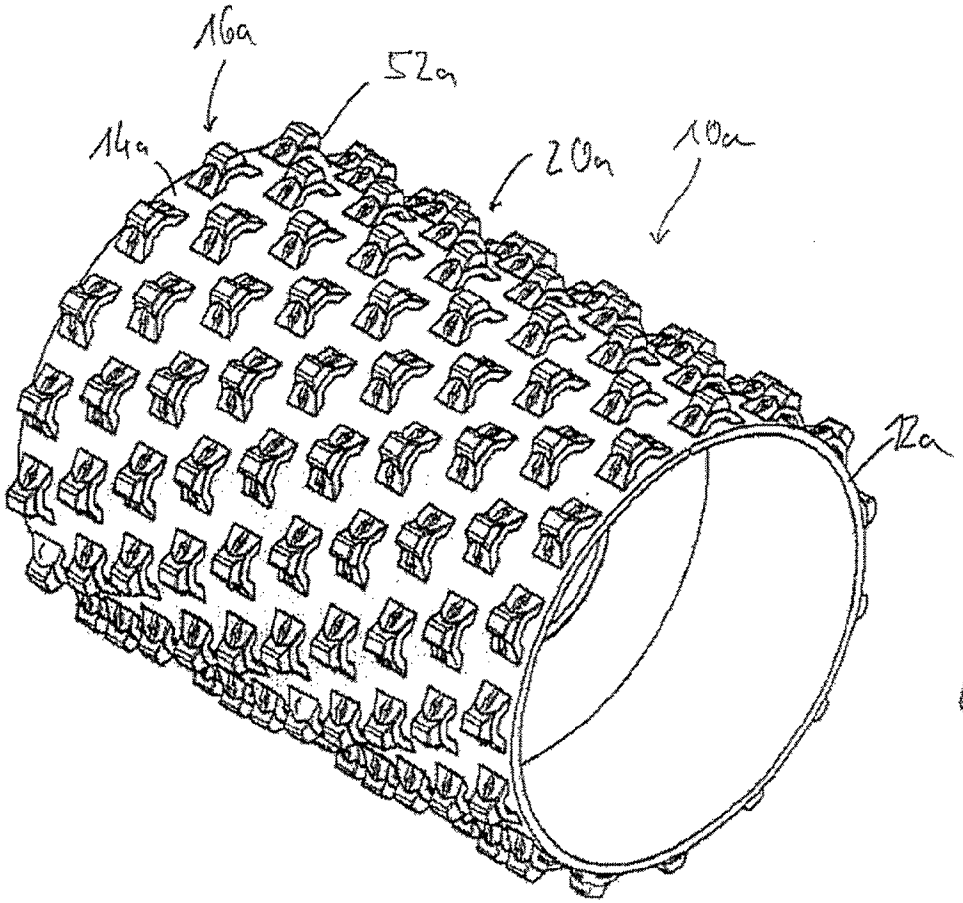
Figure 24:
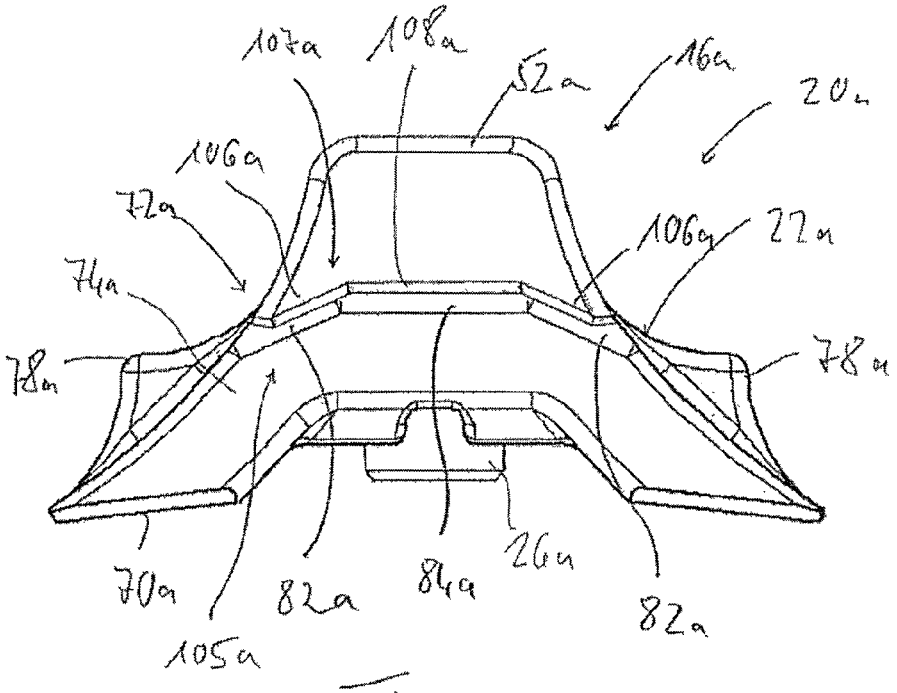
Figure 25:
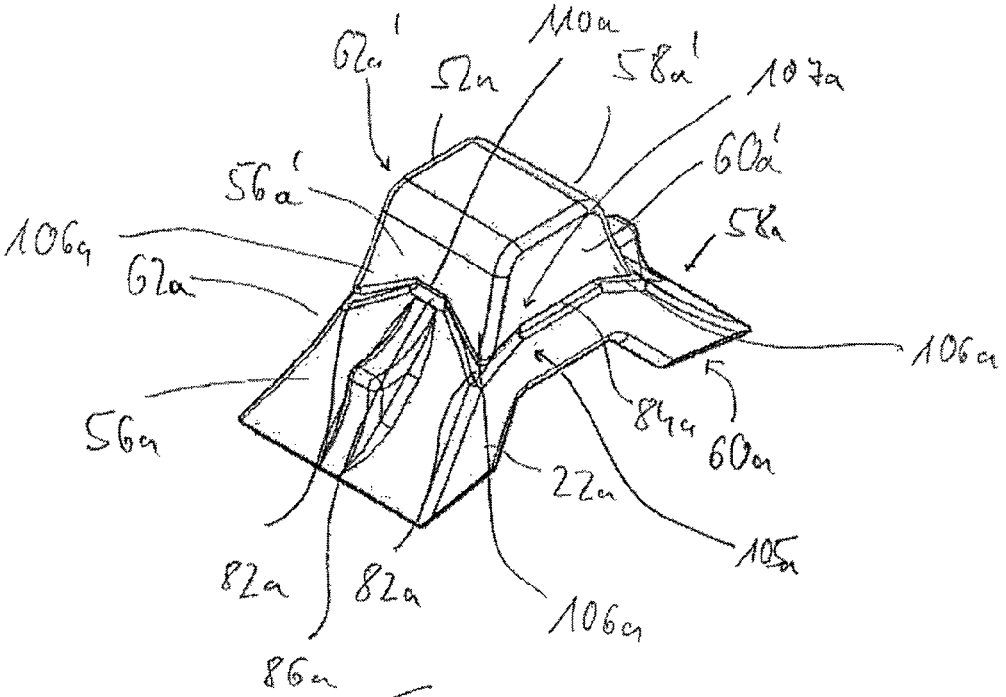
Figure 26:
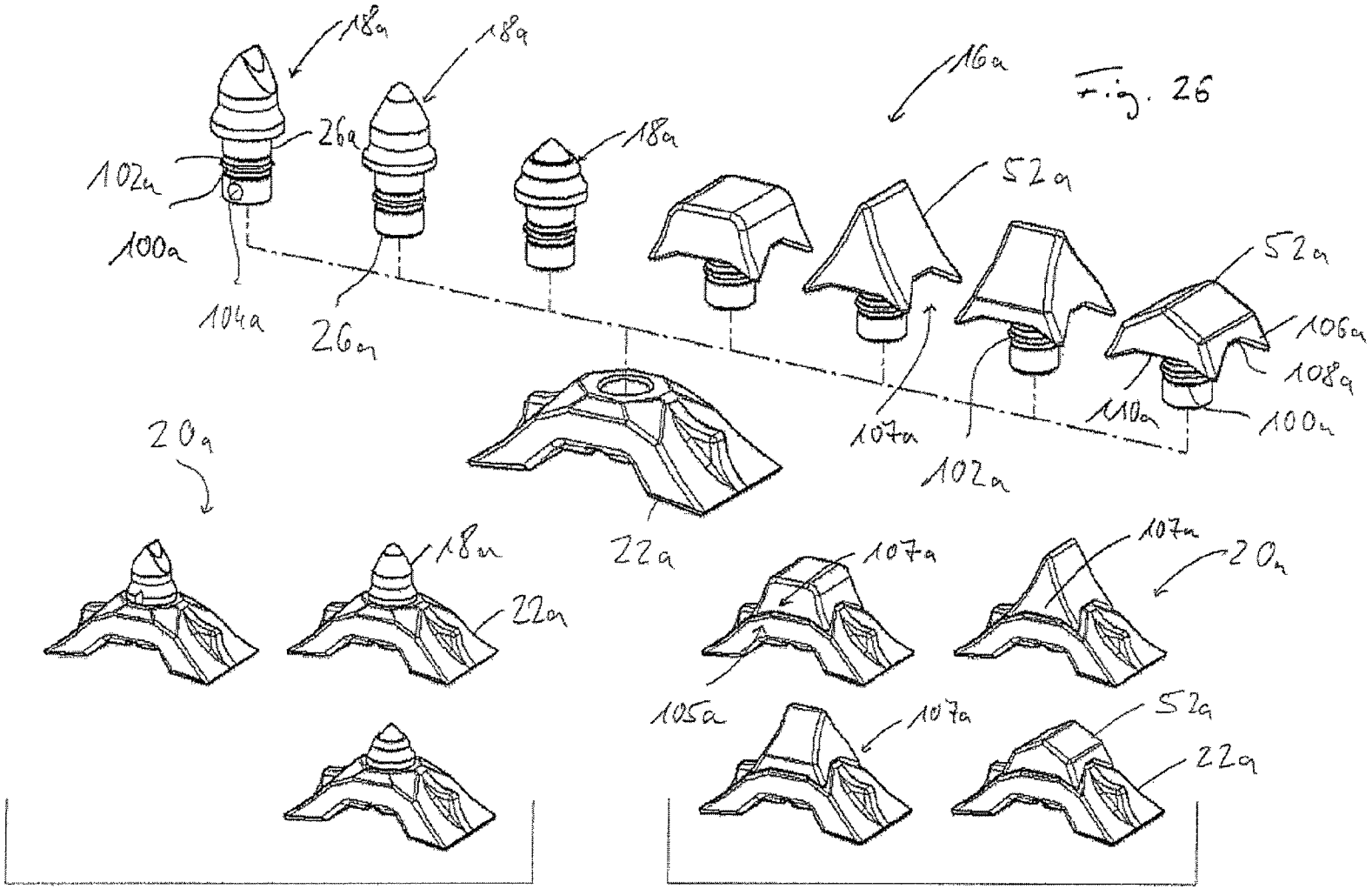
Figure 27:
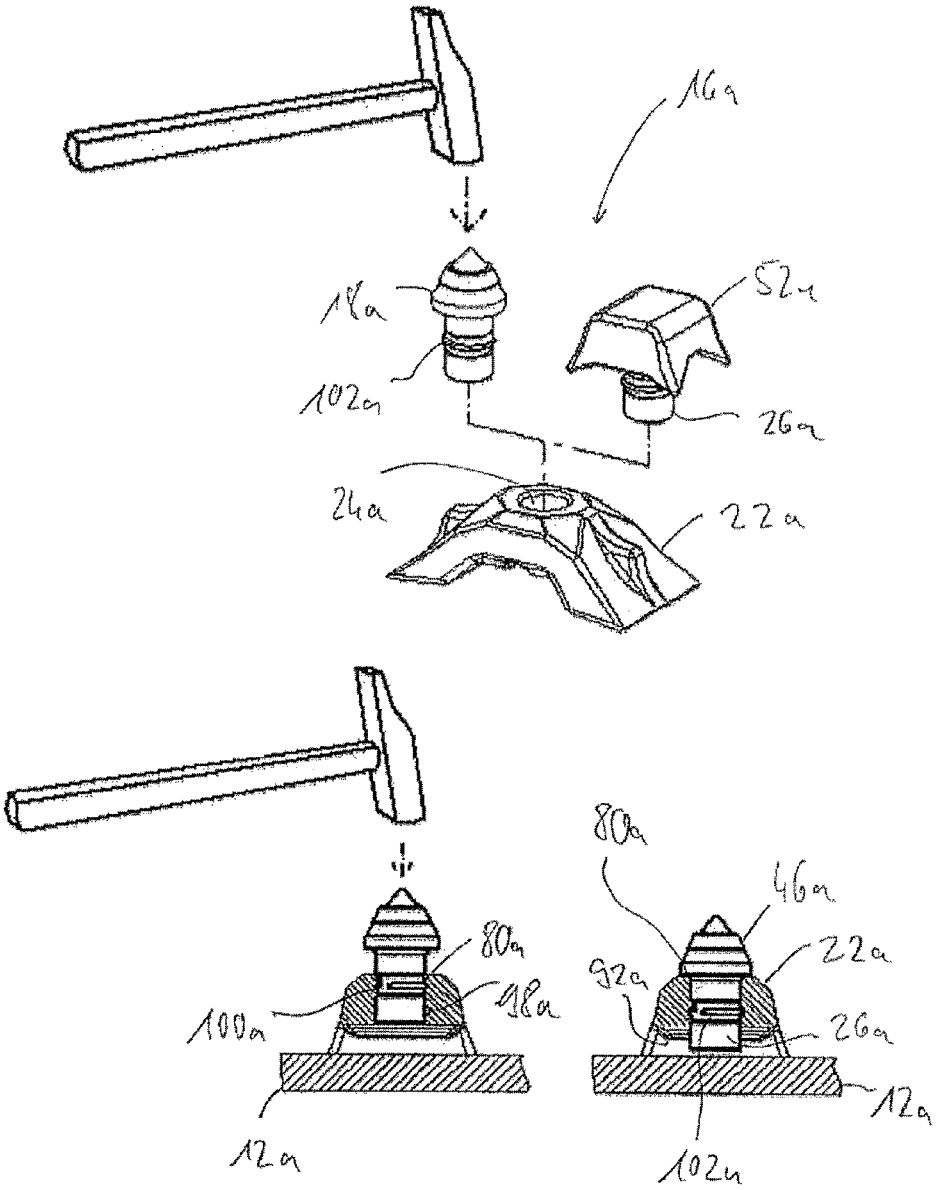
Figure 28:
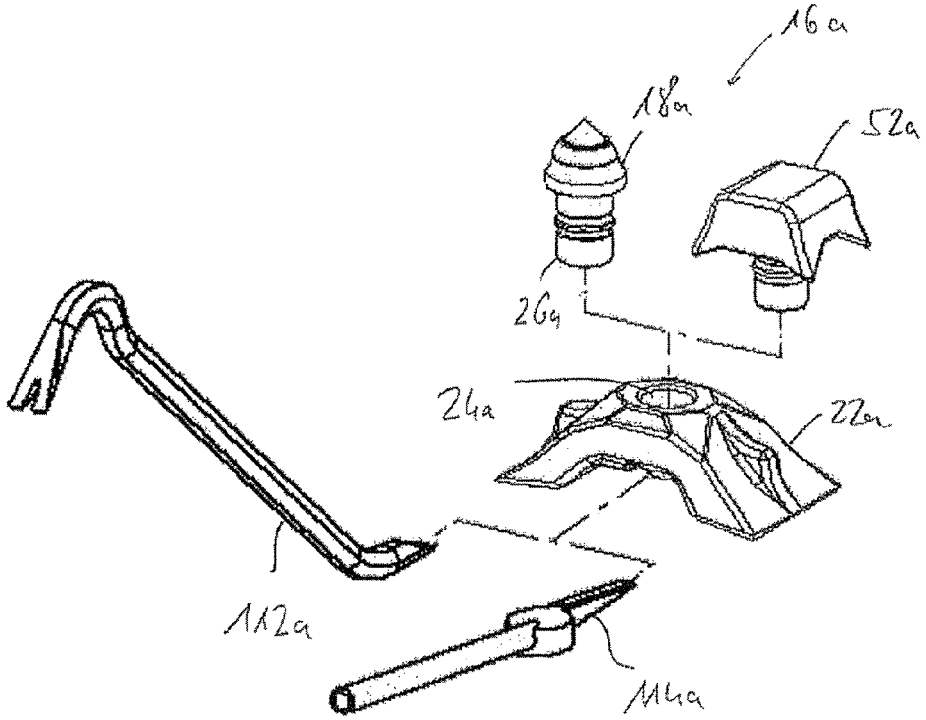
Figure 28:
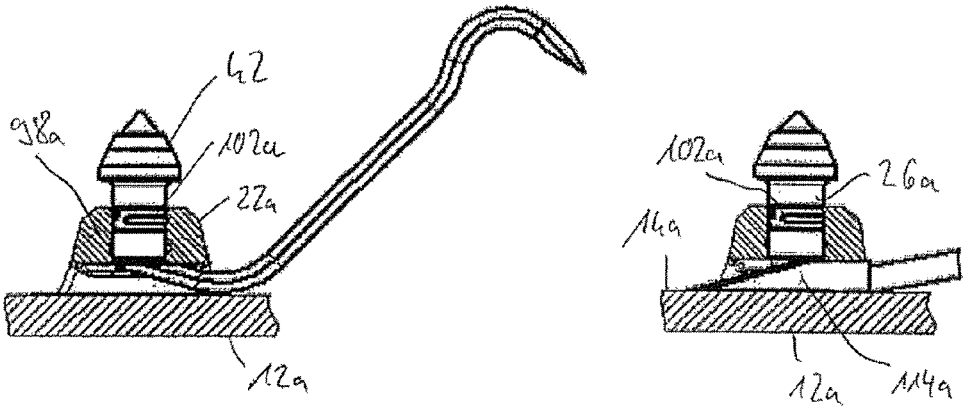

The invention will hereinafter be described in detail with reference to the attached figures. They show:

FIG. 1 a perspective view of a compactor roller having a plurality of roller tools of one type provided on the outer circumference thereof that can be used in a soil compactor;

FIG. 2 a partial cross-sectional view of the compactor roller of FIG. 1;

FIG. 3 an exploded view of an change holder arrangement having a roller tool, an change holder and a locking member;

FIG. 4 a view of a compactor roller corresponding to FIG. 1 having roller tools of a different type;

FIG. 5 a partial cross-sectional view of the compactor roller of FIG. 4;

FIG. 6 an exploded view of an change holder arrangement having a roller tool, an change holder and a locking member;

FIG. 7 another view of a compactor roller corresponding to FIG. 1 having roller tools of two different types on the outer circumference;

FIG. 8 a partial cross-sectional view of the compactor roller of FIG. 7;

FIG. 9 an exploded view of an change holder arrangement having a roller tool, an change holder and a locking member;

FIG. 10 an exploded view of an change holder arrangement having a roller tool, an change holder and a locking member;

FIG. 11 a perspective view of an alternative type of embodiment of a compactor roller corresponding to FIG. 1 having a plurality of roller tools provided on the outer circumference thereof;

FIG. 12 a partial cross-sectional view of the compactor roller of FIG. 11;

FIG. 13 a lateral view of an change holder used in the compactor roller of FIG. 11, viewed in the direction of an axis of rotation of the compactor roller having a roller tool of one type mounted thereon;

FIG. 14 a perspective view of the change holder of FIG. 13;

FIG. 15 a perspective view of the change holder of FIG. 13 without the roller tool;

FIG. 16 another perspective view of the change holder of FIG. 13;

FIG. 17 a view corresponding to FIG. 13 without the roller tool mounted on the change holder;

FIG. 18 a lateral view of the change holder of FIG. 13 viewed in the circumferential direction;

FIG. 19 the change holder of FIG. 17 viewed in the direction of vision XIX in FIG. 17;

FIG. 20 the change holder of FIG. 17 viewed in the direction of vision XX in FIG. 17;

FIG. 21 a partial axial view of the compactor roller of FIG. 11 while processing soil;

FIG. 22 the compactor roller of FIG. 11 with other roller tools mounted on the change holders;

FIG. 23 a partial cross-sectional view of the compactor roller of FIG. 22;

FIG. 24 a view of the change holder of the compactor roller of FIG. 22 having a roller tool of a different type attached thereto, viewed in the direction of an axis of rotation of the compactor roller;

FIG. 25 a perspective view of the change holder having the roller tool of FIG. 24 mounted thereon;

FIG. 26 different roller tools to be combined with an change holder;

FIG. 27 a procedure for mounting a roller tool on an change holder;

FIG. 28 a procedure for removing a roller tool from an change holder.

FIG. 1 shows a compactor roller in general designated with 10 that can be used in a soil compactor. The compactor roller 10 that can be rotated about a roller axis A when the compactor is operated comprises a cylindrical roller sleeve 12. A plurality of roller tools 16 is provided on an outer peripheral surface 14 of the roller sleeve 12. These roller tools 16 are provided in the form of chisels 18, in particular so-called round shaft chisels, in the exemplary embodiment shown in FIGS. 1 to 3.

The roller tools 16 or chisels 18 can be fastened on the compactor roller 10 by means of the respective change holder arrangements 20 described hereinafter in detail with reference to FIGS. 2 and 3.

The change holder arrangements 20 comprise an change holder 22 made of metal with its connection area 76 on the outer peripheral surface 14 of the roller sleeve 12 fastened, or that can be fastened, by way of example, by means of welding, with a holder opening 24 configured therein and, by way of example, radially oriented relative to the roller axis A and radially open outward. A holder shaft 26 is respectively configured on the roller tools 16, namely the chisels 18 in the shown example, whose outer contour corresponds to that of the holder opening 24, namely circular in the shown example. The holder shaft 26 forms a counter-holder 28 which can be brought into engagement with the change holder 22 by introducing said counter-holder 28 into its holder opening 24.

In an end section facing away from the outer peripheral surface 14 the change holder 22 forms a support area 72 with a preferentially annular peripheral first support surface 80 around the holder opening 24. Said support surface 80 preferentially has a planar configuration and can be orthogonal relative to the radial direction of the roller axis A. In order to fasten the chisel 18 on the change holder 22 the holder shaft 26 is, by way of example, pressed into the holder opening 24 until a first counter-support region 97 contacts the chisel head 46 on the first support surface 80. The forces developing during the soil processing operation which load the chisel 18 in the direction of the change holder 22, can thus essentially be absorbed by supporting the counter-support area 97 on the first support surface 80.

It is visible in FIG. 3 that a preferentially peripheral groove-like recess 30 is provided in the holder shaft 26. When the holder shaft 26 is completely inserted in the holder opening 24, this groove-like recess 30 is located in a longitudinal section of the holder opening 24 in which two hole-like recesses 32, 34 configured in the change holder 22 are positioned. These hole-like recesses 34 are in an approximately orthogonal plane relative to the longitudinal opening axis $L_1$ of the holder opening 24 and exit into, or touch the holder opening 24.

An essentially U shaped locking member 36 forms locking pins 38, 40 with both its U legs, which can be inserted into the recesses 32, 34. When the holder shaft 26 is completely inserted in the holder opening 24, the groove-like recess 30 is aligned with the recesses or holes 32, 34 open toward the holder opening 24, so that when the locking member 36 is completely pushed in, the locking pins 38, 40 pass through the recesses 32, 34 and engage in the groove-like recess 30. In order to lock the locking member 36 to the change holder 22, the locking member 36 can be configured, by way of example, with curved holding sections 42, 44 whose curvature is at least approximately adapted to the curvature of the groove-like recess 30, so that these holding segments 42, 44 create a engaging effect co-operating with the groove-like recess 30. Other fixations or engaging formations can, obviously, also be used to secure the locking member 36 on the change holder 22 and/or on the counter-holder 28 against loss.

By means of the design of an change holder arrangement described with reference to FIG. 3 it is possible to easily fasten roller tools 16 on the compactor roller 10 or again remove them therefrom. By designing the roller tools 16 as chisels 18 with a chisel head 46 and a chisel tip 48 made of hard metal, by way of example, provided therein, such mounting/removal is possible for replacing worn chisels 18. Chisels of different geometries adapted to the currently intended use can obviously also be fastened on the compactor roller 10.

As is visible in FIG. 1, the change holders 22 are arranged on the outer circumference of the compactor roller 10 in a plurality of annular rows 50 extending around the roller axis A. The change holders 20, which are provided in axially immediately adjacent rows 50 are offset relative to one another in the direction of the rows, in other words in the circumferential direction, so that a very dense pack of the roller tools 16 at a nevertheless maintained separation is accomplished.

FIGS. 4 to 6 show a compactor roller 10 of the previously described design in which pad feet 52 are provided as roller tools 16 instead of the chisels 18 described above. As is in particular shown in FIG. 6, the embodiment of an change holder arrangement described above with reference to FIG. 3 can identically also be used for fastening the pad feet 52. For this purpose, the holder shaft 26 acting as a counter-holder 28 is fastened, by way of example, by means of welding, on the inner side of the pad feet 52 configured as hollow parts. By inserting the holder shaft 26 into the holder opening 24 provided in a dedicated change holder 22 and subsequently locking it by means of the locking member, each pad foot 52 can be fastened on the circumference of the compactor roller 10. Owing to the arrangement of the change holders 22 on the outer circumference of the compactor roller 10 in respective rows 50 described above with reference to FIG. 1, a corresponding row-like configuration of the now provided pad feet 52 results on the outer circumference of the compactor roller 10.

The pad feet 52 are designed with a front side 54 facing away in the direction of the outer peripheral surface 14 of the roller sleeve 12, two peripheral sides 56, 58 being oriented in the circumferential direction and two axial sides 60, 62 being oriented in the axial direction. The peripheral sides 56, 58 include a greater angle of inclination to the front side 54 than the axial sides 60, 62. At their contact areas 64 to be brought into contact with the outer peripheral surface 14 located opposite the respective front side 54, the pad feet 52 are configured with a curved structure adapted to the curvature of the roller sleeve 12 or of the outer peripheral surface 14. This curved structure can be accomplished by correspondingly shaping the end section of both axial sides 60, 62 circularly, or by means of a segmental linear curved structure, which is however approximately circular as a whole. In this way, it is ensured that the pad feet 52 locked to the compactor roller 10 by means of the respective change holder arrangements 20 are also secured against rotation, although the respective holder shafts 26 can in principle be rotated in the dedicated holder openings 24 owing to the cross-sectional geometry and also to the locking effect of the locking members 36. This rotatability is an advantage when using chisels as roller tools, as a one-sided wear thereof can be prevented. It is thus possible to lock a variety of roller tools 16 required to meet different requirements, that is, on the one hand, rotatability, and on the other hand security against rotation, with one and the same change holder 22.

In order to ensure this variability, namely providing roller tools of different types and thus also of different sizes on the outer circumference of the compactor roller 10, it is furthermore advantageous to provide the change holders 22 spaced apart from the respectively adjacent change holders 22 in the circumferential direction as well as in the axial direction such that roller tools of bigger sizes in the respective directions can be attached on the immediately adjacent change holders 22. This in particular means that the distance between two rows 50 in the axial direction should at least correspond to half the width of a respective pad foot measured between both axial sides 60, 62.

In order to move the locking members 36 into the dedicated recesses 32, 34, 30 in the exemplary embodiment shown in FIGS. 4 to 6, it is advantageous to arrange at least one of the axial sides 60, 62 with an opening 66 through which the locking member 36 can be inserted and also disengaged.

FIGS. 7 to 10 show an exemplary embodiment in which roller tools 16 of different types are distributed over the outer circumference of one and the same compactor roller 10. The chisels 18 already described above with reference to FIG. 1 as well as the pad feet 52 described above with reference to FIG. 4 are provided. In this case, the arrangement can in particular be such that a periodic pattern of roller tools 16 of one type and roller tools 16 of another type is provided in each row 50. Chisels 18 alternating with pad feet 52 are in particular visible in FIG. 7.

With the design shown in FIGS. 7 to 10 in which the change holder arrangements 20 already described above are again used, and in fact in connection with pad feet 52, as well as in connection with chisels 18, it can furthermore, by way of example, be provided that the chisels 18 have a larger projection height over the outer peripheral surface 14 of the roller sleeve 12 than the pad feet 52. A projection height of a new chisel 18 can, by way of example, be selected in the range of more than 10 mm. This ensures that the chisel heads 46 reaching beyond the front surfaces 54 can adequately apply their abrasive or crushing effect in spite of the presence of the pad feet 52.

FIGS. 11 and 12 show a compactor roller that can be used in a soil compactor of an alternative design, in particular with respect to the change holder arrangements. The components corresponding to components described above with respect to design or function are designated with the same reference numerals with the addition of a suffix "a".

In the compactor roller 10*a* shown in FIG. 11, a plurality of change holder arrangements 20*a* is also provided on the outer peripheral surface 14*a* of the cylindrical roller sleeve 12*a*. Advantageously, the arrangement here is also such that rows 50*a* are formed by consecutive change holder arrangements 20*a*, wherein the change holder arrangements 20*a* are offset relative to one another in the circumferential direction by rows 50*a* that are adjacent in the direction of the axis of rotation of the compactor roller or roller axis A, by way of example, by approximately half the peripheral length of such an change holder arrangement 20*a*. This results in a very uniform coverage of the outer peripheral surface 14*a* of the roller sleeve 12*a*, so that the soil can be intensively processed and a direct contact of the peripheral surface 14*a* with the soil to be processed can to a large extent be prevented. This contact in fact occurs between the roller tools to be still described below and the soil to be processed, so that intensive pressure can be applied thereto.

In the design of a compactor roller 10*a* shown in FIGS. 11 and 12, chisels 18*a* are respectively attached on the change holders 22*a* of the change holder arrangements 20*a*, which are again also configured, by way of example, as round shaft chisels in this case. The design of these change holder arrangements 20*a* comprising, by way of example, chisels 18*a*, in particular also of the change holders 22*a* thereof, shall hereinafter be described in detail with reference to FIGS. 13 to 20.

In the top view or radial view shown in FIG. 19 and also 20, the change holder 22*a* has an approximately rectangular outer contour, and in the lateral view shown, by way of example, in FIGS. 13 and 17, viewed in the direction of the roller axis A, has an approximately trapezoidal outer contour.

The change holder 22*a* is to be positioned with a connection area 70*a* adjacent to the outer peripheral surface 14*a* of the roller sleeve 12*a* and is advantageously fastened by means of welding with its connection area 70*a* on the outer peripheral surface 14*a*. In doing so, a peripheral welding seam can advantageously be formed around the rectangular contour of the connection area 70*a*. In its superficial area 71*a* to be positioned adjacent to the outer peripheral surface 14*a*, the connection area 71*a* can be adapted to the circularly curved outer contour of the roller sleeve 12*a* in order to achieve a contact as extensive as possible and thus a load distribution as uniform as possible.

Starting at the connection area 70*a*, the change holder 22*a* has a tapering contour in the direction away from the outer peripheral surface 14*a* and toward a support area in general designated with 72*a*. Both peripheral sides 56*a*, 58*a* oriented in the circumferential direction as well as both axial sides 60*a*, 62*a* oriented in the direction of the roller axis A are in this case arranged at an angle to one another. By comparing FIGS. 17 and 18, it becomes clear that both peripheral sides 56*a*, 58*a* enclose a greater angle to one another than both axial sides 60*a*, 62*a*. It should be noted here that the peripheral sides 56*a*, 58*a* or also the axial sides 60*a*, 62*a* do not necessarily need to comprise absolutely straight surfaces. As FIGS. 17 and 18 clearly show, the change holder 22*a* can be configured curved, by way of example, concave at its peripheral sides 56*a*, 58*a* and/or its axial sides 60*a*, 62*a*.

As will still be described in detail below, the change holder 22*a* with a soil processing area 74*a* between the connection area 70*a* and the support area 72*a* is free, even when a roller tool 16*a* is attached on the change holder 22*a* for contacting the soil to be processed. In contrast to the embodiment also shown, by way of example, in FIGS. 5 and 6, in which the change holder is completely covered by the roller tool mounted thereon, the change holder 22*a* contacts the soil or substrate to be processed and thus contributes to an improved processing result owing to the more intensive contact independently of which roller tool is mounted thereon.

On each of both its peripheral sides 56*a*, 58*a*, the change holder 22*a* has a rib-like or tooth-like soil processing projection 78*a* for a reinforced interaction with the soil to be processed. Said soil processing projection 78*a* protrudes from the respective peripheral side 56*a* or 58*a* and in its central area, viewed in the direction of the extension of the connection area 70*a* to the direction of the support area 72*a*, has a maximum projection height. The projection height decreases toward the connection area 70*a* as well as in the direction of the support area 72*a*, where, as it is clearly shown, by way of example in FIG. 17, an essentially curved, advantageously concave contour of the respective soil processing projection can be provided.

The interaction of such an change holder 22*a* or of a chisel 18*a* mounted as a roller tool thereon, is shown with the soil to be processed B in FIG. 21. It is visible there that on moving forward and downward in the direction of the soil to be processed, a chisel 18*a* moved in the direction of the soil to be processed B can contact the soil to be processed B, in particular stone fragments, and crush them by applying load on them. Correspondingly, the processing projections 78*a* can also contact the stone fragments and generate an additional crushing effect.

In its support area 72*a* the change holder 22*a* has a holder opening 24*a* that is used for fastening the respective roller tool. Said holder opening 24*a* is advantageously configured or oriented in the change holder such that its longitudinal opening axis $L_1$ essentially extends radially relative to the roller axis A when the change holder 22*a* is fastened on the outer peripheral surface 14*a*.

A first support area 80*a* is provided that annularly surrounds the holder opening 24*a*. The first support area 80*a* is preferentially oriented such that it is essentially orthogonal to a radial line relative to the roller axis A, that is, a radial direction which essentially also corresponds to the orientation of the longitudinal opening axis $L_1$ in FIG. 16. In this case the first support surface 80*a* can also essentially be planar. A slight curve, in particular convex curve, of the first support surface 80*a* is in principle not excluded.

Second support surfaces 82*a* are formed in the support area 72*a* where a peripheral side 56*a* or 58*a* is adjacent to an axial side 60*a* or 62*a*. These four second support surfaces 82*a* lying diametrically opposite to one another in pairs relative to the longitudinal opening axis $L_1$ are arranged at an angle relative to one another and are also respectively arranged at an angle to a radial direction, as well as to the first support surface 80*a* and to the peripheral sides 56*a*, 58*a* and axial sides 60*a*, 62*a*, which they are respectively adjacent to.

Third support surfaces 84*a* are respectively provided in the support area 72*a* on both axial sides 60*a*, 62*a* between both second support surfaces 82*a*. These are also arranged at an angle to one another relative to the second support areas 82*a* and relative to the first support surface 80*a*, which they are adjacent to. Fourth support surfaces 86*a* are provided between the adjacent second support surfaces 82*a* on both peripheral sides 56*a*, 58*a*. These can also be arranged at an angle to one another relative to the second support surfaces 82*a* and relative to the first support surface 80*a*.

The second to fourth support surfaces 82*a*, 84*a*, 86*a* can respectively be configured as plane surfaces so that a facet-like contour of the support surfaces respectively adjacent to one another results in a whole. As is in particular apparent in connection with the fourth support surfaces 86*a*, a curved embodiment of such support surfaces is in principle also possible.

In order to keep interfering surfaces essentially oriented parallel to the soil to be processed as small as possible in the change holder 22*a*, it is advantageously configured as chamfered or rounded where the support surfaces or sides are adjacent to one another. A dome-like or curved total arrangement, which to a large extent prevents the occurrence of interfering surfaces, also develops in the support area 72*a* as a result of the second to fourth support surfaces 82*a*, 84*a*, 86*a* annularly surrounding the first support surface 80*a*.

The change holder 22*a* is designed with its trapezoidal contour viewed from the axial side such that with two change holder legs 88*a* providing a partial area of the attachment area

70*a* and a central area 90*a* providing a support area 72*a* connecting both change holder legs 88*a* and also the support area 72*a*, it forms a spread U shape. Both change holder legs 88*a* and the central area 90*a* together with the outer peripheral surface 14*a* of the roller sleeve 12*a* thus surround an inner space of the change holder 92*a* which, by way of example, is open on both axial sides 60*a*, 62*a*. A continuous anti-rotation recess 94*a*, by way of example, from the axial side 60*a* to the axial side 62*a*, likewise running across the holder opening 24*a* and open in the direction of the outer peripheral surface 14*a*, is provided on the underside of the central area 90*a* facing the outer peripheral surface 14*a*. An anti-rotation member that will still be described below can be positioned engaging in this anti-rotation recess 94*a* and prevent the rotation of a roller tool 16*a* mounted on the change holder 22*a*.

To fasten the roller tool also visible, by way of example, in FIGS. 13 and 14, which is configured as a chisel 18*a* on the change holder 22*a*, the holder shaft provided on the chisel 18*a* acting as a counter-holder 28*a* is inserted into the holder opening 24*a*. A longitudinal axis $L_2$ of the holder shaft 26*a* in this position then essentially also corresponds to the longitudinal axis $L_1$ of the holder opening 24*a* and is also radially oriented relative to the roller axis A.

The chisel 18*a* can in this case be inserted with its holder shaft 26*a* into the holder opening 24*a* until the chisel head 46*a* contacts the first support surface 80*a* with a counter-support area 97*a* protruding over the holder shaft 26*a* radially outward relative to the longitudinal axis of the holder shaft $L_2$. A first annular peripheral groove-like locking member receiving opening 98*a* open radially inward relative to the longitudinal axis $L_1$ can be configured on the inner peripheral surface of the holder opening 28*a*. Similarly, as it is clearly visible also in FIG. 10, a second groove-like, preferentially completely peripheral locking-member receiving opening 100*a* open radially outward relative to the longitudinal axis $L_2$ of the holder shaft 26*a* can be configured on the outer circumference of the holder shaft 26*a*. This locking-member receiving opening for receiving an annular locking member 102*a* is also visible, by way of example, in FIG. 26 on the different roller tools 16*a* or their holder shafts shown there.

On insertion of the holder shaft 26*a* into the holder opening 24*a*, this locking member 102*a* configured as a stop ring or clip ring can be pressed further into the second locking-member receiving opening 100*a* until both locking-member receiving openings are aligned with one another in the course of insertion and the locking member 102*a* protruding radially outward also locks into place in the first locking-member receiving opening on the change holder 22*a*. In order to facilitate or support this radial compression of the locking member 102*a* the holder opening 24*a* can be configured in its section adjacent to the first support surface 80*a* with an insertion slope 103*a*. The roller tool 16*a* or the chisel 18*a* is thus secured against undesired detachment from the change holder 20*a*. The particularly very high forces to be applied to the chisel 18*a* in the direction of the change holder 22*a* when driving over soil are absorbed by supporting the counter-support area 97*a* on the first support surface 80*a*.

If, in addition to the locking effect of the locking member 102*a* against the movement of a chisel 18*a* out of the change holder 22*a*, a rotatory movement of the chisel 18*a* is to be prevented, an opening 104*a* can be configured in the holder shaft 26*a* thereof, which is aligned with the anti-rotation recess 94*a* in the change holder 24*a* when the holder shaft 26*a* is fully inserted in the opening 24*a*. An anti-rotation member configured like a pin, by way of example, can then be inserted from an axial side 60*a* or 62*a* into the opening 104*a* through the anti-rotation recess 94*a* and retained there, by way of example, by means of a clamping effect. The rotation of the chisel 18*a* can to a large extent be prevented in this way. This is in particular an advantage if the chisel 18*a* is configured with a non-rotational symmetric profile in its tip area provided for processing a substrate.

FIGS. 22 to 25 show the use of a compactor roller 10*a* of the design described above in particular also with reference to FIG. 10 in connection with pad feet 52*a* used as roller tools 16*a*. These interact with the change holders 22*a*, described in detail above with respect to their design, to provide the change holder arrangements 20*a*. As FIGS. 24 and 25 clearly show, the pad feet 52 used together with the change holders 22*a* as roller tools 16*a*, in particular the soil processing area 74*a* thereof not covered by the respective pad feet 52*a*, result in an assembly acting as a pad foot as a whole. In this case, it can in particular be provided that the peripheral sides 56*a*', and 58*a*' of a respective pad foot 52*a* continue the peripheral sides 56*a*, 58*a* of an change holder 22*a*, by way of example, with a similarly curved profile or oriented at an angle to one another. Correspondingly, the axial sides 60*a*' and 62*a*' can continue the axial sides 60*a* and 63*a* of the change holder 22*a*.

To be fastened on a respective change holder 22*a* such a pad foot 52*a* has a holder shaft 26*a* which, as it is also similarly indicated in FIG. 6, extends downward from the respective pad foot 52*a* and can be arranged on the change holder 82*a* passing through the holder opening 24*a*. A locking effect against detachment of the pad foot 52*a* can, by way of example, again be achieved by means of a locking member 102*a* that is also visible in FIG. 26.

In order to prevent the rotation of the pad foot 52*a* on the change holder 22*a*, it is configured such that it can be engaged in an anti-rotation positive form-locking with the different support surfaces configured in the support area 72*a*, in particular the second and third support surfaces 82*a*, 84*a*. In this case, the second to fourth support surfaces 82*a*, 84*a*, 86*a*, or the support surfaces interacting with a pad foot 52*a* and acting in an anti-rotation manner form a positive form-locking formation 105*a*, while the pad foot 52*a* provides a counter-positive form-locking formation 107*a* with its technical measures that will still be described below.

To interact with the second support surfaces 82*a* the pad foot 52*a* is configured in its four corner areas, in other words in the respective transition area between one of the peripheral sides 56*a*', 58*a*' to one of the axial sides 60*a*', 62*a*', with prolonged counter-support areas 102*a* extending in the direction of the holder shaft 26*a*. They are formed such that they have surfaces complementary to the inclined second support surfaces 82*a* which fully rest on the second support surfaces 82*a*. Owing to the angular arrangement of the second support surfaces 82*a* relative to one another and to the corresponding embodiment of the second counter-support areas 106*a*, a positive form-locking engagement preventing the rotation of the pad foot 52*a* on the change holder 22*a* around the longitudinal axis of the holder shaft 26*a* is accomplished. A rotation could only occur if the pad foot 52*a* was taken off the change holder 22*a*, which, however, is prevented by the locking effect of the locking member 102*a*.

A corresponding mutual contact interaction could also be accomplished with third counter-support areas 108*a* formed on the axial sides 60*a*' and 62*a*' of the pad foot 52*a* between respective counter-support areas 106*a* co-operating with the third support surfaces 84*a*. Such an anti-rotation positive form-locking interaction could also be accomplished or supported in fourth counter-support areas 110*a* respectively formed on the peripheral sides 56*a*' and 58*a*' between two second counter-support areas 106*a* by co-operating with the fourth support surfaces 86*a* on the change holder 22*a*.

FIG. 26 shows the variability of the change holder arrangement 20*a* described above with respect to the usability of different roller tools 16*a*. Three different exemplary chisels 18*a* are shown which can be coupled to the change holder 22*a* depending on the requirements. Four different pad feet 52*a* are furthermore shown which are identically designed in particular for a positive form-locking interaction with the support area 72*a* of the change holder 22*a* preventing rotation on the change holder 22*a* in the area of their respective counter-positive form-locking formation 107*a*. All of these different roller tools 16*a* can be attached to a compactor roller 10*a*, on which the change holders 22*a* described above are fastened. In this case, any combination of different roller tools 16*a* is possible.

FIG. 27 shows the procedure for attaching a roller tool 16*a*, which is, by way of example, the chisel 16*a* [sic, 18*a*] or the pad foot 52*a*, to the change holder 22*a*. The roller tool 16*a* to be attached in each case is inserted with its holder shaft 26*a* into the holder opening 24*a* provided on the change holder 22*a* and, by way of example, pushed in with hammer strokes until the locking member 102*a* configured as a stop ring clicks into the locking-member receiving opening in the change holder 22*a*. The final assembled state is shown at the bottom right of FIG. 27*a*. In this state, the chisel head 46*a* rests with its counter-support area 97*a* protruding radially over the holder shaft 26*a* on the first support surface 80*a* of the change holder 22*a*. The locking member 102*a* engages in the aligned locking-member receiving openings 98*a*, 100*a*.

FIG. 28 shows the procedure for removing a roller tool 26*a*, in other words, by way of example, the chisel 18*a*, or the pad foot 52*a*, from the change holder 22*a*. As can be seen at the bottom right of FIG. 27, in the assembled state the holder shaft 26*a* protrudes into the inner space of the change holder 92*a*. This state can be used for laterally reaching into the inner space of the change holder 92*a*, by way of example, by means of a crowbar 112*a* or a similarly bent tool, engaging under the holder shaft 26*a* and, by tilting it into the first locking-member receiving opening 98*a* provided on the change holder 22*a* eliminating the locked state of the locking member 102*a*, pushing out the roller tool 16*a*, in this case, by way of example, the chisel 18*a*, from the opening 24*a* at least until it can be completely pulled out of the opening 24*a* by additionally grabbing the part of the roller tool 16*a* lying outside the chisel holder 22*a*.

A sliding wedge 114*a* can be used as an alternative tool which is laterally pushed into the inner space of the holder tool 92*a* and by supporting itself on the outer peripheral surface 14*a* displaces the holder shaft 26*a* in the opening 26*a*, namely again until the locking member 102*a* gives up its engaging effect. For this purpose, the sliding wedge 114*a* can be pressed into the inner space of the change holder 92*a* by means of hammer strokes. In doing so, comparatively large forces can be generated which can eliminate the engaging effect of the locking member 102*a*.

As far as the roller tool 16 [sic, 16*a*] is additionally secured against rotation on the change holder 22*a* by an anti-rotation member, prior to the displacement of the holder shaft 26*a*, this anti-rotation member can, of course, be pushed out of the opening 104*a* in the holder shaft 26*a* receiving it in order to consequently facilitate the displacement of the holder shaft 26*a* in the direction of the longitudinal axis $L_2$.

It should finally be mentioned that with the design according to the present invention, other roller tools, in particular also other differently shaped chisels, or differently shaped pad feet, or also different patterns provided on the outer circumference of a compactor roller can, of course, be attached. It should furthermore be noted that by means of the change holder arrangements to be provided according to the present invention the roller tools must not necessarily be positioned directly on the outer peripheral surface of the roller sleeve. By way of example, it is also possible to provide an unstructured, plain roller sleeve and surround it, by way of example, with a multi-part shell-like sheath on which the chisel holders are then fastened and the different roller tools can be attached.

The invention claimed is:

1. A compactor roller for a soil compactor comprising;

at least one change holder on the outer circumference for attaching a roller tool, wherein at least one roller tool to be fastened on a change holder comprises a counter-holder that can be engaged and retained with a change holder and locked relative to the change holder, wherein the change holder comprises a holder opening and the counter-holder comprises a holder shaft that can be inserted into the holder opening, wherein at least one change holder has a connection area adapted to the curved outer circumference of the compactor roller for connecting to an outer peripheral surface of the compactor roller and a support area configured to support a roller tool and arranged at a distance from the outer peripheral surface of the compactor roller, and wherein in the support area, the holder opening is surrounded at the change holder by a first support surface that is essentially orthogonal with respect to a radial direction relative to an axis of rotation of the compactor roller.

2. The compactor roller according to claim 1, wherein a plurality of rows extending annularly around an axis of rotation of the compactor roller respectively having a plurality of change holders is provided.

3. The compactor roller according to claim 1, wherein the change holders are offset to one another in the direction of rows that are immediately adjacent in the direction of the axis of rotation.

4. The compactor roller according to claim 1, wherein the counter-holder can be locked by means of a locking member to the change holder.

5. The compactor roller according to claim 1, wherein the locking member comprises at least one locking pin, wherein at least partly aligned locking-member receiving recesses are provided on the change holder and on the counter-holder when the holder shaft is inserted in the holder opening.

6. The compactor roller according to claim 5, wherein the locking member is U-shaped and provides two locking pins.

7. The compactor roller according to claim 1, wherein the at least one roller tool comprises a chisel, and/or that at least one roller tool comprises a pad foot.

8. The compactor roller according to claim 7, wherein a pad foot used as a roller tool has an essentially curved contact area adapted to the curved outer circumference of the compactor roller.

9. The compactor roller according to claim 1, wherein exclusively roller tools of one type are provided on the compactor roller.

10. The compactor roller according to claim 1, wherein roller tools of at least two different types are provided on the compactor roller.

11. The compactor roller according to claim 2,
wherein roller tools of one type and roller tools of another type alternate with one another in a periodic pattern in at least one row.

12. The compactor roller according to claim 1,
wherein the at least one change holder is configured tapering from the connection area toward the support area.

13. The compactor roller according to claim 12,
wherein the at least one change holder has two peripheral sides essentially oriented in the circumferential direction as well as two axial sides essentially oriented in the direction of an axis of rotation of the compactor roller, wherein the peripheral sides are inclined toward one another at a greater angle than the axial sides.

14. The compactor roller according to claim 12,
wherein between the connection area and the support area, the at least one change holder has a soil processing area coming into contact with the soil to be processed when a roller tool is attached thereto.

15. The compactor roller according to claim 13,
wherein at least one soil processing projection provided on at least one peripheral side in the soil processing area.

16. The compactor roller according to claim 15,
wherein the at least one soil processing projection has a projection height increasing away from the connection area to a maximum projection height, and/or has a projection height decreasing from the maximum projection height toward the support area.

17. The compactor roller according to claim 1,
wherein at least one roller tool comprises a first counter-support area that can be supported on the first support surface.

18. The compactor roller according to claim 12,
wherein a positive form-locking formation is provided in the support area to create a positive form engagement with a counter-positive form-engagement formation on a roller tool.

19. The compactor roller according to claim 1,
wherein a plurality of second support surfaces arranged at an angle to one another is provided in the support area around the holder opening, wherein every second support surface is provided on one axial side in the adjacent area of a peripheral side.

20. The compactor roller according to claim 19,
wherein on at least one axial side in the support area a third support surface is provided between two second support surfaces arranged at an angle relative thereto, and/or that on at least one peripheral side in the support area a fourth support surface is provided between two second support surfaces arranged at an angle relative thereto.

21. The compactor roller according to claim 1,
wherein that at least one of the second support surfaces, the third support surfaces, and the fourth support surfaces are arranged at an angle relative to the first support surface and annularly surround it.

22. The compactor roller according to claim 19,
wherein at least one roller tool has at least one of the following:
(i) at least one second counter-support area as a support on a second support surface,
(ii) at least a third counter-support area as a support on a third support surface, and
(iii) at least one fourth counter-support area as a support on at least one fourth support surface.

23. The compactor roller according to claim 1,
wherein a transition area of at least one of at least one peripheral side, at least one axial side, the first support surface, at least one second support surface, at least one third support surface, and at least one fourth support surface, are chamfered or rounded relative to at least one of a respectively adjacent other side and surface.

24. The compactor roller according to claim 1,
wherein an annular groove-like first locking member receiving opening is provided on the inner circumference of the holder opening, and/or that an annular groove-like second locking member receiving opening is configured on the outer circumference of the holder shaft.

25. The compactor roller according to claim 24,
wherein an annular locking member is received in the first locking-member receiving opening, or in the second locking-member receiving opening for locking a roller tool to a change holder into the respectively other locking member-receiving opening.

26. The compactor roller according to claim 1,
wherein a receiving opening is provided on a holder shaft provided on a roller tool for an anti-rotation member to be positioned engaging an anti-rotation recess on the change holder.

27. The compactor roller according to claim 1,
wherein at least one change holder encloses an inner space of the change holder with an outer peripheral surface of the compactor roller, where the inner space of the change holder is open on at least one axial side essentially oriented in the direction of the axis of rotation of the compactor roller.

28. The compactor roller according to claim 27,
wherein when a roller tool is attached to the change holder, a holder shaft provided on the roller tool protrudes through a holder opening provided on the change holder into the inner space of the change holder.

29. The compactor roller according to claim 1,
wherein the holder opening provided on the change holder has a longitudinal opening axis essentially radially oriented relative to the axis of rotation of the compactor roller, and that when a roller tool is attached to the change holder, a longitudinal holder shaft axis of the holder shaft provided on the roller tool is essentially oriented in the radial direction.

30. A soil compactor comprising at least one compactor roller according to claim 1.

* * * * *